United States Patent [19]

Westberg

[11] 4,295,288

[45] Oct. 20, 1981

[54] HOLDER FOR INFORMATION CARRIERS IN STRIP FORM

[75] Inventor: Ake G. Westberg, Sundsvall, Sweden

[73] Assignee: H. L. Plast H. Lundvall AB, Sundsvall, Sweden

[21] Appl. No.: 962,849

[22] Filed: Nov. 22, 1978

Related U.S. Application Data

[63] Continuation-in-part of Ser. No. 841,764, Oct. 13, 1977, abandoned.

[30] Foreign Application Priority Data

Oct. 15, 1976 [SE] Sweden ..... 7611481

[51] Int. Cl.[3] ..... G09F 3/18

[52] U.S. Cl. ..... 40/16.4

[58] Field of Search ..... 40/10 R, 10 C, 10 D, 40/16 R, 16.2, 16.4, 606

[56] References Cited

U.S. PATENT DOCUMENTS

| | | | |
|---|---|---|---|
| 2,353,469 | 7/1944 | Hopp | 40/16.2 |
| 2,527,900 | 10/1950 | Warmath | 40/16.2 |
| 2,547,239 | 4/1951 | Walker | 40/16.6 |
| 2,679,846 | 6/1954 | Addison | 40/16.6 |
| 2,730,825 | 1/1956 | Wilds | 40/16.2 |
| 2,800,732 | 7/1957 | Duran | 40/11 R |
| 2,813,359 | 11/1957 | Ferdinand | 40/16.2 |
| 2,861,369 | 11/1958 | Widmaier | 40/159 |
| 3,269,042 | 8/1966 | Carpenter | 40/16.2 |
| 3,324,585 | 6/1967 | Frederickson | 40/11 R |
| 3,337,977 | 8/1967 | Sobesky | 40/10 R |

FOREIGN PATENT DOCUMENTS

| | | | |
|---|---|---|---|
| 594868 | 3/1934 | Fed. Rep. of Germany | 40/10 D |
| 358564 | 1/1962 | Switzerland | 40/16.2 |

*Primary Examiner*—Gene Mancene
*Assistant Examiner*—Wenceslao J. Contreras
*Attorney, Agent, or Firm*—Sughrue, Mion, Zinn, Macpeak & Seas

[57] ABSTRACT

A holder for information carriers in strip form. The holder comprises a fitting part and a part for reception of the information carriers connected to the fitting part. The part for reception of the information carriers is in the form of an upwardly open pocket having a transparent front wall forming the front surface of the holder. To allow for easy opening of the pocket the rear wall of the pocket is connected to the fitting part at a distance from the bottom of the pocket.

10 Claims, 9 Drawing Figures

HOLDER FOR INFORMATION CARRIERS IN STRIP FORM

This application is a continuation-in-part of Application Ser. No. 841,764, filed Oct. 13, 1977, now abandoned.

BACKGROUND OF THE INVENTION

This invention relates to a holder for information carriers in strip form, comprising a fitting part and a part connected thereto for reception of the said information carriers.

Holders of the aforesaid kind are used extensively in grocery shops and department stores, inter alia to display data and prices of various goods. The holders are there intended to be applied to the edges of shelves, wire baskets or the like and may be in the form of very long strips. It is of the utmost importance in this context that they should allow simple replacement of information carriers, particularly when these consist of a plurality of short labels disposed side by side which are required to be selectively replaceable. The holders must also be simple and inexpensive to manufacture, allow easy cleaning and not be dust-collectors.

Present day holders do not simultaneously satisfy all these requirements. In a prior art holder, the information carriers are in fact protected and the holder is easy to clean, but the information carriers have to be introduced from below, for which purpose the front wall of the holder has to be bent out. The consequence is that if a short information carrier is to be exchanged the adjacent information carriers are also released when the front wall of the holder is bent out, which usually results in their dropping onto the floor

SUMMARY OF THE INVENTION

A main object of the present invention is to provide a strip-shaped holder for information carriers in the form of strips, which holder satisfied all the aforesaid requirements.

According to the invention, this is achieved in that, in a holder of the introductorily described type, the part intended for reception of the said information carriers is in the form of an upwardly open pocket, the front wall of which is transparent and forms the front surface of the holder, and in which holder the rear wall of the pocket is connected to the said fitting part at a distance from the bottom of the pocket.

The upper, free edge of the front wall of the pocket shall, according to the invention, either snap in beneath a section protruding from the fitting part or rest resiliently under tension against a rear wall of the pocket. A holder designed in this manner embodies no open dust-accumulating spaces and allows easy cleaning while possessing the major advantage that the information carriers can be inserted into the holder from above, so that individual short information carriers can easily be replaced without adjacent information carriers dropping onto the floor.

Another highly substantial advantage of the holder according to the invention is that it can be opened in a very simple manner for replacement of information carriers even when it is made in the form of a very long holder strip. All that is required for this purpose is that pressure be applied to the lower section of the front surface of the holder strip, between its bottom edge and the position where the rear wall of the pocket is connected to the fitting part. In consequence of the resilience of the plastic material and a certain lever effect, the engagement between the upper edge of the front wall of the pocket and the part co-operating therewith will cease whereupon the front wall of the pocket can readily be gripped, held and bent out while information carriers are being replaced.

Preferably, the rear wall of the pocket is connected to the said fitting part at a distance from the bottom of the pocket corresponding to at least approximately one third of the height of the pocket.

The front wall of the pocket is arranged to engage by its upper free edge beneath a section protruding from the fitting part. The entire holder is appropriately extruded in one piece.

In the embodiment in which the front wall of the pocket is intended to rest against a rear wall under tension, the front wall of the pocket is made, for reasons of manufacturing technique, appropriately as a separate part, adapted to be attached by its bottom edge to the fitting part which is appropriately extruded in one pice.

Preferably, the walls of the pocket extend in an arc between its bottom and top edges, inter alia, enabling the information carriers to be displayed in an attractive manner.

BRIEF DESCRIPTION OF THE DRAWINGS

The invention will be described in detail below with reference to the accompanying drawings, wherein.

DESCRIPTION OF THE PREFERRED EMBODIMENTS

Figure 1:
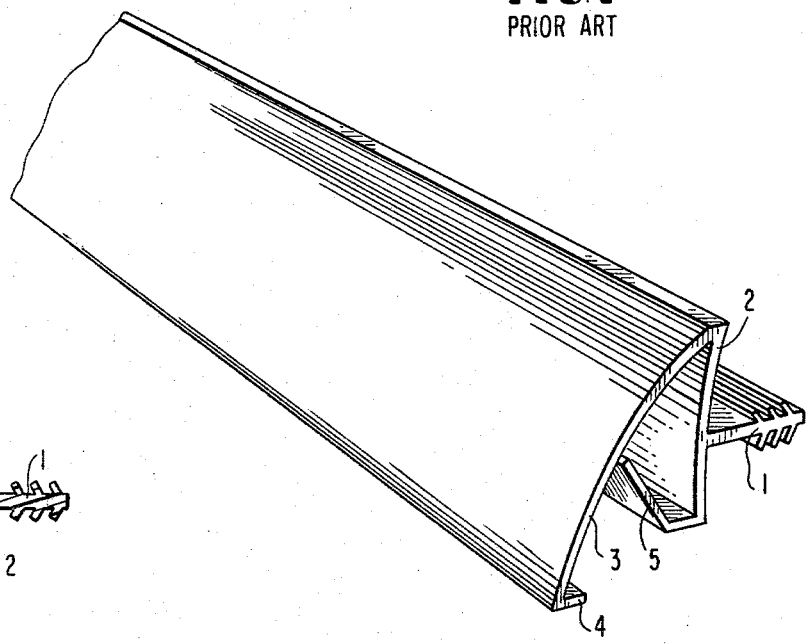
FIG. 1 PRIOR ART
FIG. 1 is a perspective view of a strip-shaped holder of the prior-art type.
Figure 2:
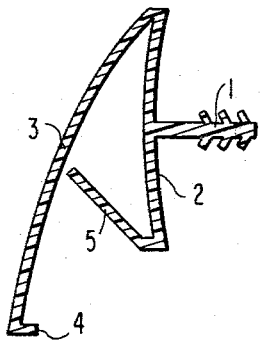
FIG. 2 PRIOR ART
FIG. 2 is a cross-section of the holder according to FIG. 1.

The holder according to FIGS. 1–2 is intended for fitting to the front edge of a shelf provided with a groove, usually a wooden shelf. For this purpose, the flanged part 1 is pressed into the groove to a depth such that the rear, curved part 2 of the holder bears against the edge of the shelf. In consequence of the curvature, very reliable anchoring of the holder in the groove is obtained, while at the same time effective sealing is afforded against the shelf edge along the top and bottom edges respectively of the holder.

In the prior art strip-shaped holder according to FIGS. 1 and 2, it is necessary for insertion of information carriers that the front part 3 of the holder be bent slightly outwards so that the strip-shaped information carriers can be placed on the flange 4 protruding inwardly from the bottom edge of the part 3. When the latter springs back into place, the carriers can be clamped between the part 3 and the inclined part 5.

The most serious disadvantage of a holder according to FIGS. 1 and 2 is that the information strips have to be inserted from below while the front part 3 is bent outwards. The consequence of this is that if, for example, one of several short information strips carried in the holder is to be replaced, the strips adjacent to the one which is to be replaced will be released when the part 3 is bent out and may drop onto the floor.

Figure 3:
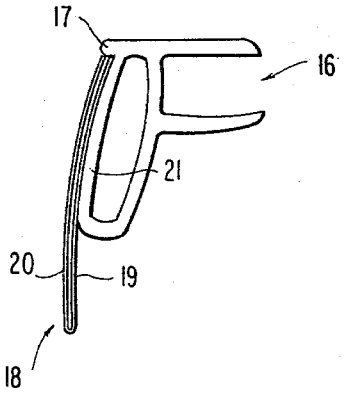
FIG. 3 is a perspective end view of one embodiment of a strip-shaped holder according to the invention.
Figure 4:
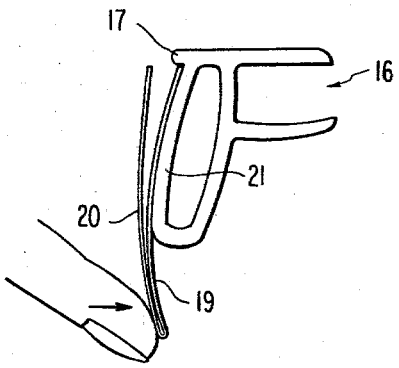
FIG. 4 illustrates opening of a holder according to FIG. 3.

In the strip-shaped holder according to the invention, one embodiment of which is shown in FIGS. 3 and 4, this problem has been solved in that the part of the holder which is to receive the strip-shaped information carriers is made in the form of an upwardly open pocket 18 of slot-shaped cross-section, the front wall 20 of which forms the front surface of the holder. The upper edge of the rear wall 19 is attached beneath a flange 17 protruding forwardly from the attachment portion 16. The rear wall 19 of the pocket 18 is connected at a distance from its lower edge to a wall 21 of the attachment portion 16. Preferably, the pocket 18 is constructed of a flexible, clear plastic material while the attachment portion 16 is thicker and less flexible. The material used for pocket 18 should permit the label to be read electronically with a "reading pen" or the like.

In the holder strip according to the invention, the strip-shaped information carriers are introduced by simply putting them down into the pocket 18, when the upper edge of the wall 20 is held at a certain distance from the flange 17. The implication is that short information strips can easily be exchanged without any risk of adjacent information strips dropping out. The upper edge of the wall 20 can be arranged to fit beneath the flange 17 so that the requirement that the holder should not be dust-accumulating and should allow easy cleaning has also been satisfied. This holder, like the prior art holder shown in FIGS. 1 and 2, thus allows cleaning with liquid without any liquid penetrating to the information carriers. This is a requirement which has previously been difficult to combine with simple replacement of individual information carriers as will be apparent from the above remarks in connection with FIGS. 1 and 2. It is thus only by means of the holder strip according to the invention that these requirements can be simultaneously satisfied.

In order, inter alia, to improve the closure properties of the pocket 18 the wall 20 of pocket 18 is prestressed against the attachment portion 16. The pocket 18 is then appropriately imparted a certain curvature which facilitates reading of information carriers inserted in the holder.

In the embodiment illustrated, the rear wall 19 of the pocket 18 is secured to the wall 21 of the attachment portion 16 along its upper portion. As such, the pocket 18 can easily be opened at its upper edge by application of a pressure to its bottom section between the lower edge and the position of the wall 21, thereby allowing simple insertion and/or replacement of information strips. After insertion or replacement, the pressure on the bottom section is released and the upper edge of the wall 20 will spring back into place, alternately, a protrusion can be provided on the flange 17 to form a snap fit for the upper edge of the wall 20.

Figure 5:
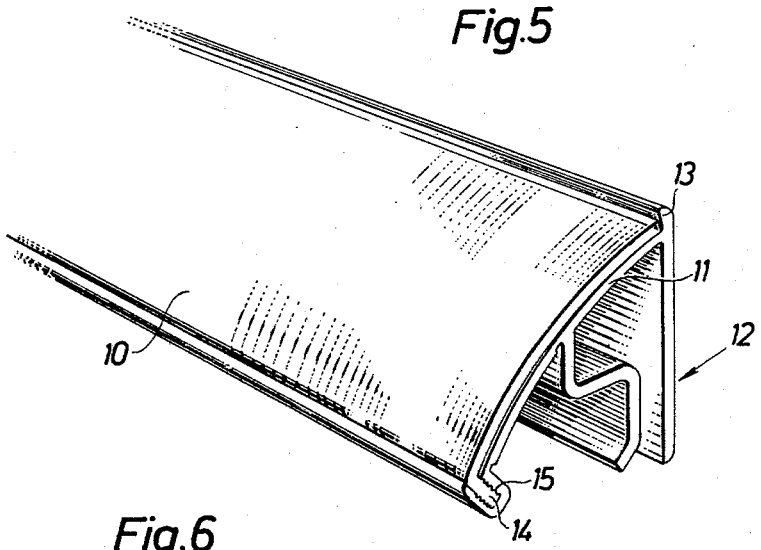
FIG. 5 is a perspective view of another embodiment of a holder according to the invention.
Figure 6:
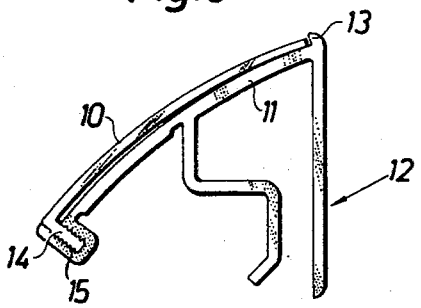
FIG. 6 is a cross-section of the holder shown in FIG. 5.

FIG. 5 shows another embodiment of the holder strip according to the invention, in which the upper free edge of the front wall 10 of the pocket formed between it and the rear wall 11 rests under tension against the rear wall 11 and in which no direct snap engagement with a part 13 protruding from the fitting part 12 is necessary. To achieve the requisite prestressing of the front wall 10 of the pocket, it is extruded for reasons of manufacturing technique as a separate unit. The front wall 10 of the pocket is in this embodiment made with a protruding flange 14, which is adapted to be pressed into a corresponding groove 15 disposed on the rear wall 11 of the pocket which is connected to the fitting part 12. The wall 10 may, however, also be attached to the rear wall 11 by some other optional means. Since the wall 10 is extruded separately, a relatively large contact force against the rear wall 11 of the pocket can be obtained even in the case of a slot-shaped pocket of very small width. The above-described embodiment of the holder strip also enables the same design of the front wall 10 of the pocket to be utilized together with different holder strips, the fitting parts of which differ to allow fitting to the desired objects.

Figure 7:
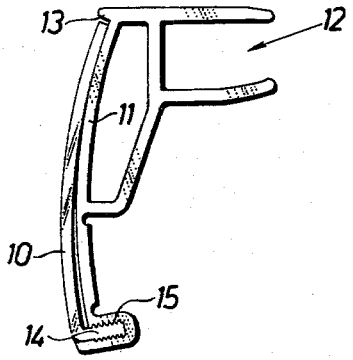
FIG. 7 is a cross-section of a varient of the holder according to FIG. 6.
Figure 8:
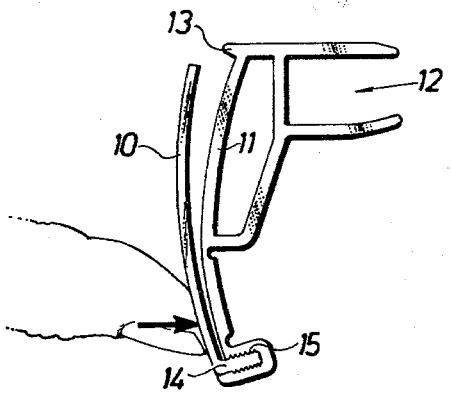
FIGS. 8 and 9 illustrate opening of a holder according to FIG. 7.
Figure 9:
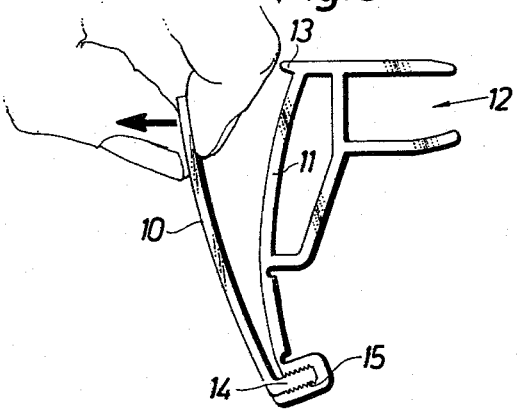

The holder strip according to the embodiments of FIGS. 3, 4, 5 and 6 are intended to be applied to a wire basket, wire shelf or the like, while the holder strip according to FIGS. 7, 8 and 9 is designed for fitting to a glass shelf. For fitting to other kinds of shelves, for example shelves made of light-alloy sections, the fitting part must be further modified. For fitting to wooden shelves the holder according to FIG. 5 can also be provided with a fixing part of the type illustrated in FIGS. 1–4. The construction of the fitting part thus does not constitute part of the present invention and must be adapted to the actual requirement.

The common feature of all embodiments is, however, that the rear of the pocket is connected to the fixing part of the attachment portion at a distance from the bottom of the pocket, to allow easy opening of the pocket as mentioned heretofore and illustrated closely in FIGS. 8 and 9. FIG. 8 thus shows how application of pressure to the front surface of the holder, between its lower edge and the lower point of attachment for the rear edge 11 of the pocket, can release the upper edge of the front wall 10 of the pocket. The latter can then easily be gripped as shown in FIG. 9 and retained in the bent-out position while the wanted information carriers are inserted into the pocket. When the wall 10 is subsequently released it will return on account of the pretension of the position where it bears against the rear wall 11 of the pocket. In the embodiment according to FIGS. 3 and 4, a light pressure is required at the upper edge of the pocket in order for the front wall 6 to snap in beneath the protective projection 7.

The opening function described above is of decisive importance for holder strips of this kind, which, as has been stated, may be of very substantial length and which otherwise will be very difficult to open without the provision of projections or the like on the front wall of the pocket, avoidance of which, however, is desirable.

What is claimed is:

1. A holder for information strips, such as price strips for supermarket shelves, goods containers and the like, comprising:

(a) an attachment portion for removably mounting the holder to a shelf, container edge or the like, (b) a display portion for receiving an information strip, said display portion defining a pocket having an upwardly directed opening and a portion extending below said attachment portion, said pocket having a prestressed transparent front wall forming a front-facing surface of said holder, said display portion flexible to deflect said front wall under a force applied to said pocket portion extending below said attachment portion thereby opening said upwardly directed opening and (c) means connecting a rear wall of said display portion to said attachment portion at a point spaced from the bottom of said pocket.

2. A holder according to claim 1, wherein the rear wall of the pocket is connected to the said attachment portion at a distance from the bottom of the pocket corresponding to at least about one third of the height of the pocket.

3. A holder according to claim 1, wherein the walls of the pocket extend in an arch between their lower and upper edges.

4. A holder according to claim 1, wherein the front and rear walls of the pocket are made in one piece and the front wall of the pocket is arranged to engage by its upper free edge beneath a protruding section of the said attachment portion.

5. A holder according to claim 1 extruded in one piece.

6. A holder according to claim 1, wherein the front wall of the pocket is made as a separate part, which is attached to the rear wall along its lower edge and held by tension against the said rear wall along its upper free edge.

7. A holder according to claim 6, wherein the rear wall of the pocket is provided with a groove along its lower edge and the front wall is provided along its lower edge with a flange fitting into the groove.

8. A holder according to claim 6, wherein the said attachment portion is provided with a section which protrudes above the upper free edge of the front wall.

9. A holder according to claim 6, wherein the said attachment portion and the rear wall of the pocket are extruded in one piece.

10. A holder according to claims 1 or 6, wherein said means connecting a rear wall to said attachment protion defines a spacer to space said portion of said pocket extending below said attachment portion from said attachment portion thereby allowing deflection of said display portion.

* * * * *